US011472652B2

(12) United States Patent
Koekebakker et al.

(10) Patent No.: US 11,472,652 B2
(45) Date of Patent: Oct. 18, 2022

(54) SHEET TRANSPORT SYSTEM

(71) Applicant: Canon Production Printing Holding B.V., Venlo (NL)

(72) Inventors: Sjirk H. Koekebakker, Venlo (NL); Joseph A. Schulkes, Venlo (NL); Johan P. Smits, Venlo (NL)

(73) Assignee: CANON PRODUCTION PRINTING HOLDING B.V., Venlo (NL)

( * ) Notice: Subject to any disclaimer, the term of this patent is extended or adjusted under 35 U.S.C. 154(b) by 0 days.

(21) Appl. No.: 17/225,870

(22) Filed: Apr. 8, 2021

(65) Prior Publication Data

US 2021/0323782 A1 Oct. 21, 2021

(30) Foreign Application Priority Data

Apr. 16, 2020 (EP) ..... 20169913

(51) Int. Cl.
*B65H 9/00* (2006.01)
*B65H 9/20* (2006.01)
(Continued)

(52) U.S. Cl.
CPC ..... *B65H 9/002* (2013.01); *B65H 7/06* (2013.01); *B65H 7/10* (2013.01); *B65H 9/00* (2013.01);
(Continued)

(58) Field of Classification Search
CPC . B65H 9/002; B65H 9/00; B65H 9/20; B65H 7/10; B65H 7/06; B65H 2301/331;
(Continued)

(56) References Cited

U.S. PATENT DOCUMENTS 4,971,304 A 11/1990 Lofthus
5,169,140 A * 12/1992 Wenthe, Jr. ..... B65H 9/002 271/227
(Continued)

FOREIGN PATENT DOCUMENTS

EP 0 814 041 A2 12/1997
EP 1 253 097 A1 10/2002
EP 2 261 150 A2 12/2010

OTHER PUBLICATIONS

European Search Report issued in Application No. EP 20 16 9913 dated Oct. 6, 2020.

*Primary Examiner* — Luis A Gonzalez
(74) *Attorney, Agent, or Firm* — Birch, Stewart, Kolasch & Birch, LLP

(57) ABSTRACT

A sheet transport system for moving a sheet in a transport direction while adjusting a position of the sheet in a lateral direction normal to the transport direction to a target position, includes first and second pinch roller sets spaced apart from one another in the transport direction, each pinch roller set including two pairs of pinch rollers spaced apart from one another in the lateral direction, each pair forming a nip for pinching and driving the sheet with an individually controllable speed; a detection system for detecting a position of the sheet in the lateral direction while the sheet is pinched by the first pinch roller set; and a control system configured for carrying out the following actions: by controlling the speeds of the pinch rollers of the first pinch roller set before the sheet has reached the second pinch roller set, rotating the sheet by a first rotation angle for adjusting a given reference point on a leading part of the sheet to its target position; and when the sheet has left the first pinch roller set and while the reference point travels along a path segment that is symmetric with respect to the second pinch roller set, rotating, by controlling the speeds of the pinch
(Continued)

rollers of the second pinch roller set, the sheet by a second rotation angle for aligning a leading edge of the sheet in the lateral direction.

9 Claims, 5 Drawing Sheets

(51) Int. Cl.
*B65H 7/10* (2006.01)
*B65H 7/06* (2006.01)

(52) U.S. Cl.
CPC ..... *B65H 9/20* (2013.01); *B65H 2301/331* (2013.01); *B65H 2404/144* (2013.01); *B65H 2404/147* (2013.01); *B65H 2511/24* (2013.01); *B65H 2513/10* (2013.01)

(58) Field of Classification Search
CPC ..... B65H 2404/144; B65H 2404/147; B65H 2511/242
See application file for complete search history.

(56) References Cited

U.S. PATENT DOCUMENTS 5,732,943 A * 3/1998 Delfosse ..... B65H 9/002 198/395
2010/0061783 A1* 3/2010 Kawasaki ..... B65H 9/002 271/228

* cited by examiner

SHEET TRANSPORT SYSTEM

BACKGROUND OF THE INVENTION

1. Field of the Invention

The invention relates to a sheet transport system for moving a sheet in a transport direction x while adjusting a position of the sheet in a lateral direction z normal to the transport direction x to a target position, the system comprising first and second pinch roller sets spaced apart from one another in the transport direction x, each pinch roller set comprising two pairs of pinch rollers spaced apart from one another in the lateral direction z, each pair forming a nip for pinching and driving the sheet with an individually controllable speed.

2. Description of Background Art

Sheet transport systems of this type are typically employed in printers or copiers or, more generally, in sheet processing apparatus for moving media sheets through successive processing stations of the apparatus.

In order to obtain a high print quality in a printer, for example, it is necessary that the sheet transport system is not only capable of supplying the sheets at the correct timings to the correct positions in the transport direction x but also to correct possible deviations of the sheets in the lateral direction z by re-adjusting the sheets to the target position. In most cases, it is also required that the sheet transport system is capable of correcting possible skew errors of the sheets by rotating the sheets such that their leading and trading edges are exactly aligned in the lateral direction z.

In known sheet transport systems, the correction of y-position errors generally requires specific moving means for moving the sheets in the lateral direction. This makes the sheet transport system complicated and expensive.

SUMMARY OF THE INVENTION

It is therefore an object of the invention to provide a sheet transport system that has a simple construction and is nevertheless capable of controlling the y-positions of the sheets.

In order to achieve this object, according to the invention, a sheet transport system for moving a sheet in a transport direction x while adjusting a position of the sheet in a lateral direction z normal to the transport direction x to a target position, the system comprising first and second pinch roller sets spaced apart from one another in the transport direction x, each pinch roller set comprising two pairs of pinch rollers spaced apart from one another in the lateral direction z, each pair forming a nip for pinching and driving the sheet with an individually controllable speed. The sheet transport system further comprises a detection system for detecting a position of the sheet in the lateral direction z while the sheet is pinched by the first pinch roller set, and a control system configured for carrying out the following actions:

- by controlling the speeds of the pinch rollers of the first pinch roller set before the sheet has reached the second pinch roller set, rotating the sheet by a first rotation angle for adjusting a given reference point on a leading part of the sheet to its target position; and
- when the sheet has left the first pinch roller set and while the reference point travels along a path segment that is symmetric with respect to the second pinch roller set, rotating, by controlling the speeds of the pinch rollers of the second pinch roller set, the sheet by a second rotation angle for aligning a leading edge of the sheet in the lateral direction z.

In the system according to the invention, the z-position of a sheet can be controlled without any specific moving means for moving the sheet in z-direction, simply by appropriately controlling the pinch rollers that are responsible for the transport of the sheet in the transport direction x. The invention takes advantage of the fact that a rotation of the sheet can be induced by driving the pinch rollers on the left and right sides of the sheet transport path with differential speed, and that such a rotation of a sheet induces a lateral movement of the leading part of the sheet that is already located downstream of the pinch roller set that induces the rotation. Consequently, the rotation can be controlled such that the leading edge of the sheet reaches the second pinch roller set in a corrected z-position. In general, however, this correction of the z-position will also lead to an unwanted change of the skew angle of the sheet. Therefore, according to the invention, the second pinch roller set is used for rotating the sheet again, this time in order to correct the skew angle. By appropriately controlling the time period in which the second rotation is performed, it can be achieved that the z-position of the center of the sheet is left unchanged in this second rotation so that, eventually, the sheet will have the correct z-position and also the correct skew angle.

More specific optional features of the invention are indicated in the dependent claims.

In one embodiment, the system can also be utilized for correcting a possible initial skew error of the sheet.

During the correction process for the z-position and/or the skew angle, the speed of the pinch rollers may also be controlled such that a possible x-position (or timing) error will also be corrected.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE PREFERRED EMBODIMENTS

Figure 1:
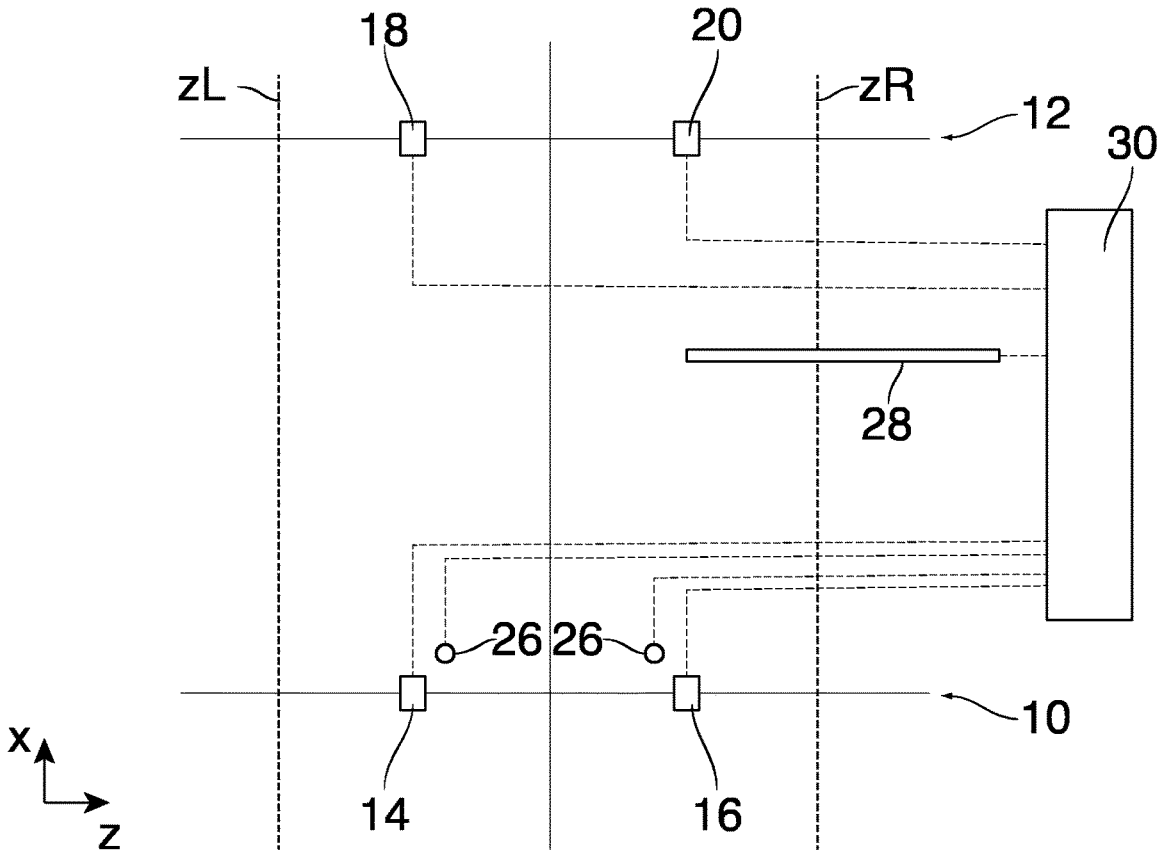
FIG. 1 is a schematic plan view of a sheet transport system according to the invention.

The present invention will now be described with reference to the accompanying drawings, wherein the same reference numerals have been used to identify the same or similar elements.

In FIG. 1, essential parts of a sheet transport system, e.g. in a printer, have been shown in plan view.

Figure 2:
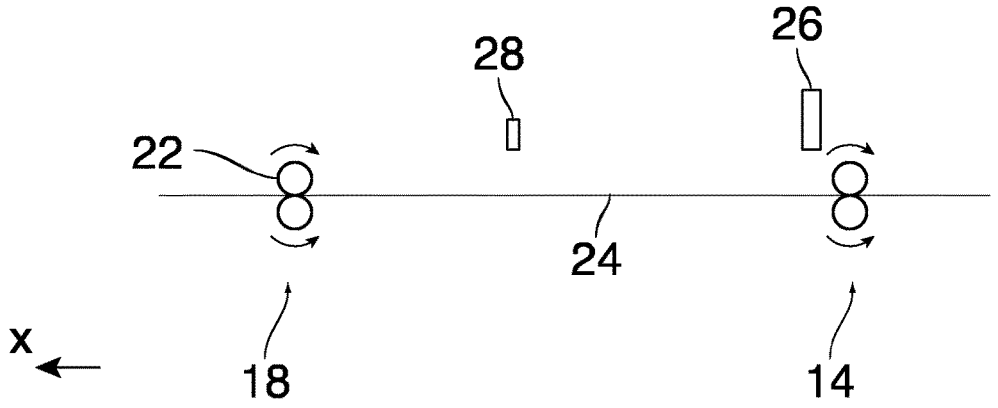
FIG. 2 is schematic side view of the sheet transport system.

The sheet transport system comprises a first pinch roller set 10 and a second pinch roller set 12 each of which comprises two pairs 14, 16, 18, 20 of pinch rollers. As is shown in FIG. 2, pinch rollers 22 of each pair form a nip for pinching a media sheet 24 that has been supplied into the nips. The pinch rollers 22 of each pair rotate in opposite directions of rotation so as to advance the sheet 24 in a transport direction x.

A sheet that arrives from below in FIG. 1 will at first be pinched and advanced only by the first pinch roller set 10 and will then be pinched and advanced also by the second pinch roller set 12, whereafter the trailing edge of the sheet will leave the nips of the pinch roller pairs 14 and 16.

Edge detectors 26 are arranged in the vicinity of each pinch roller pair 14, 16 of the first pinch roller set 10 for detecting the timings at which leading and/or trailing edges of the sheets move past the detectors.

An edge detector 28 in the form of a linear detector array is provided at a location between the first and second pinch roller sets 10, 12 for detecting a position of a lateral edge of the sheet in a lateral direction z. Thus, the edge detector 28 can detect any possible z-position error of the sheets passing through. Target positions zL and zR for the left and right edges of the sheets have been indicated by dashed lines in FIG. 1. The edge detector 28 extends in lateral direction z and can detect a z-position of a lateral sheet edge at several different points and/or times during the transportation and/or rotation of the sheet. This enables the detection system to track the z-position during a rotation for improved control. It also allows the detection system to deduce a skew angle or skew angle error which can be used to improve control. When suitably positioned, the linear detector array can further be applied to detect the skew angle of the leading and trailing edges as these pass over the detector array. This allows the function of the leading and trailing edge detectors 26 to be integrated into the linear detector array 28, such that the present invention may be without the need for separate leading and trailing edge detectors 26.

The edge detectors 26 and 28 are electronically connected to a control system 30 that contains a processor for controlling the pinch roller pairs 14, 16, 18 and 20. It will be observed that the speeds of rotation of the pinch rollers 22 can be controlled independently for each of the four pinch roller pairs.

Figure 3:
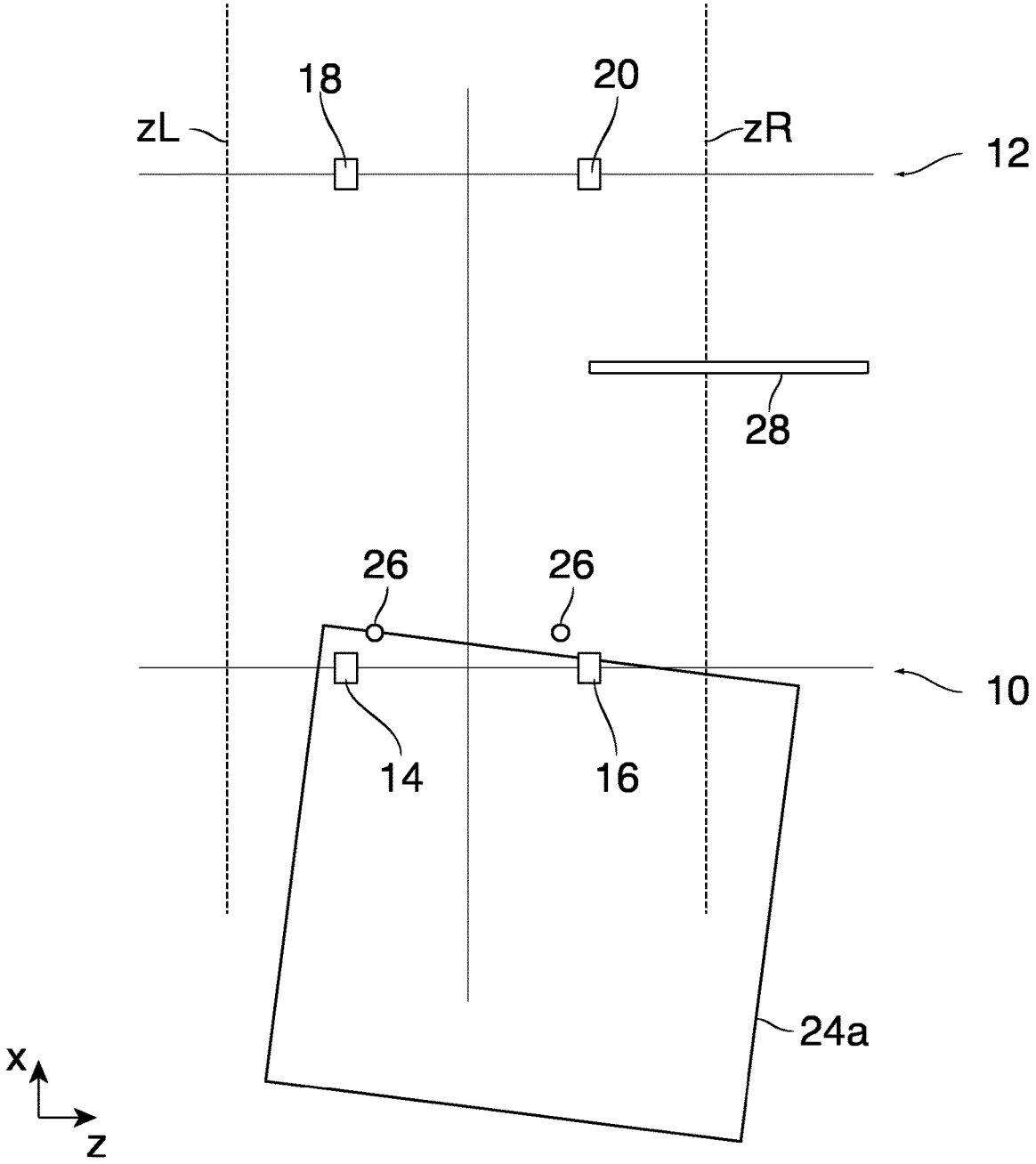
FIG. 3 is a plan view of the sheet transport system in a situation where a sheet has an initial z-position error and also a skew angle error.

FIG. 3 illustrates a situation where a sheet arrives at the first pinch roller set 10 in a position 24*a*. In this position, the sheet has a z-position error and a skew angle error, as has been shown exaggeratedly in the drawing. The skew angle error can be calculated from the known transport speed and the timings at which the leading edge of the sheet passes the edge detectors 26. Then, the pinch roller pairs 14 and 16 may be controlled to rotate the sheet so as to correct the skew angle error, as will now be explained by reference to FIG. 4.

Figure 4:
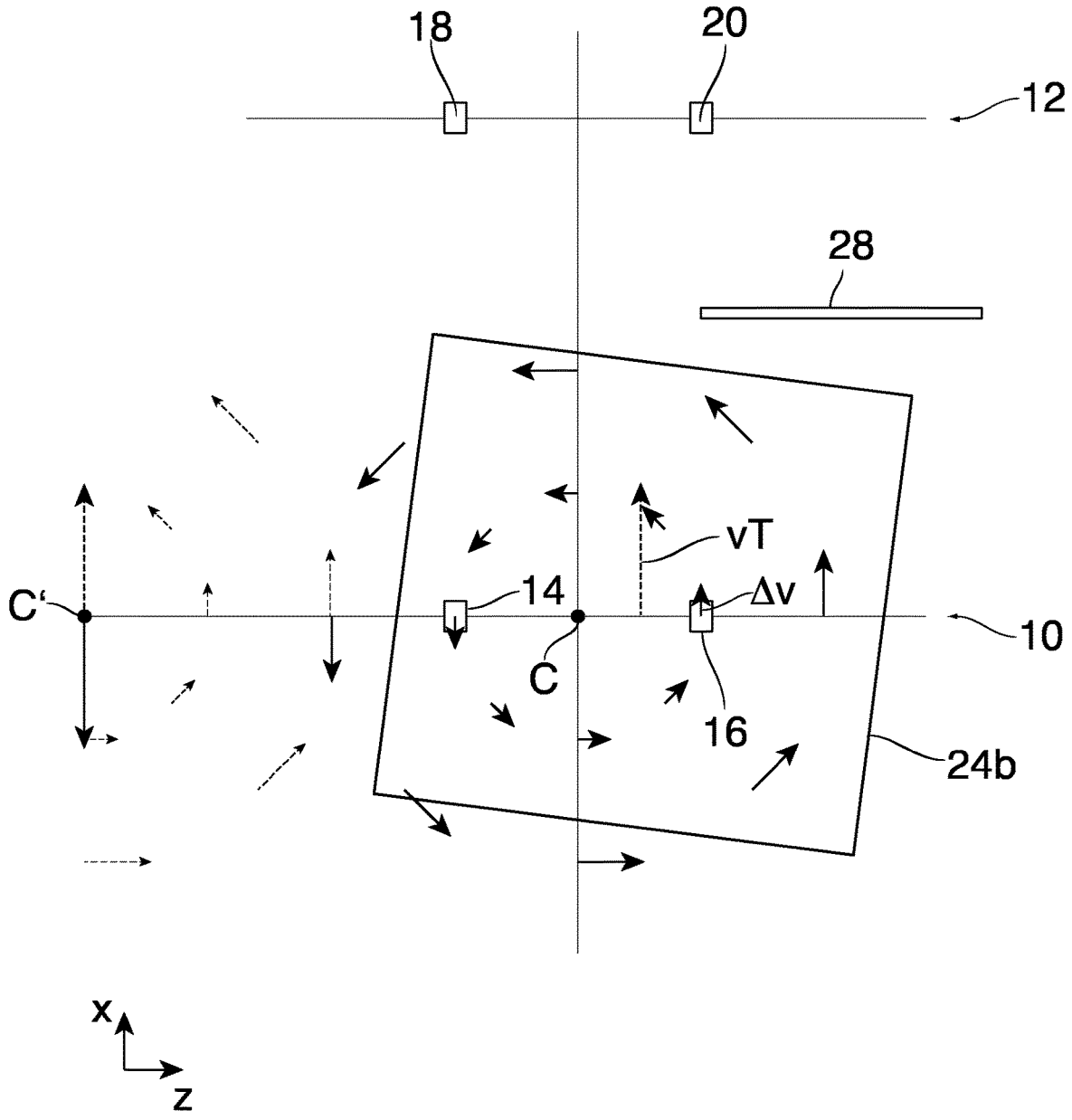
FIG. 4 is a diagram illustrating kinematics of a rotation of the sheet induced by differential speeds of pinch rollers driving the sheet in the transport direction x.

In the situation shown in FIG. 4, the sheet has been advanced further and has reached a position 24*b* in which the leading edge has not yet reached the second pinch roller set 12, so that the sheet is still driven only by the first pinch roller set 10.

For a moment, it shall now be assumed that the pinch roller pair 16 is driven to advance the sheet with a speed Δv in positive x-direction whereas the pinch roller pair 14 is driven to move the sheet with a speed having the same absolute value Δv, but in negative x-direction. As a consequence, the sheet would be rotated counter-clockwise about a rotation center point C in the middle between the pinch roller pairs 14 and 16. This rotation has been symbolized in FIG. 4 by arrows in continuous bold lines which indicate the displacement of each point of the sheet (or of a hypothetical sheet with larger dimensions). The absolute value of this displacement increases with increasing distance from the point C.

In practice, the sheet is of course advanced in positive x-direction with a certain speed vT, symbolized by a dashed arrow in FIG. 4. However, the rotation described above can be superposed to this translational movement by driving the right pinch roller pair 16 with a speed vT+Δv and driving the left pinch roller pair 14 with a speed vT-Δv. Then, the displacement at each point of the sheet would be given by a vector that is the sum of the translation vector and the local rotation vector.

At a certain point C' located on the axis of the pinch roller pairs 14 and 16, the translation vector and the rotation vector cancel each other, so that this point of the hypothetical sheet would be at rest. Thus, the movement resulting from a superposition of the translational movement with speed vT and the rotation is again a rotation, but with a centre at the point C', as has been symbolized by faint dashed arrows in FIG. 4. The angular speed of this rotation is fully determined by Av and can therefore be calculated in the control system 30. Conversely, the differential speed Δv can be controlled such that the skew angle error of the sheet will be fully corrected after the lapse of a given period of time.

Figure 5:
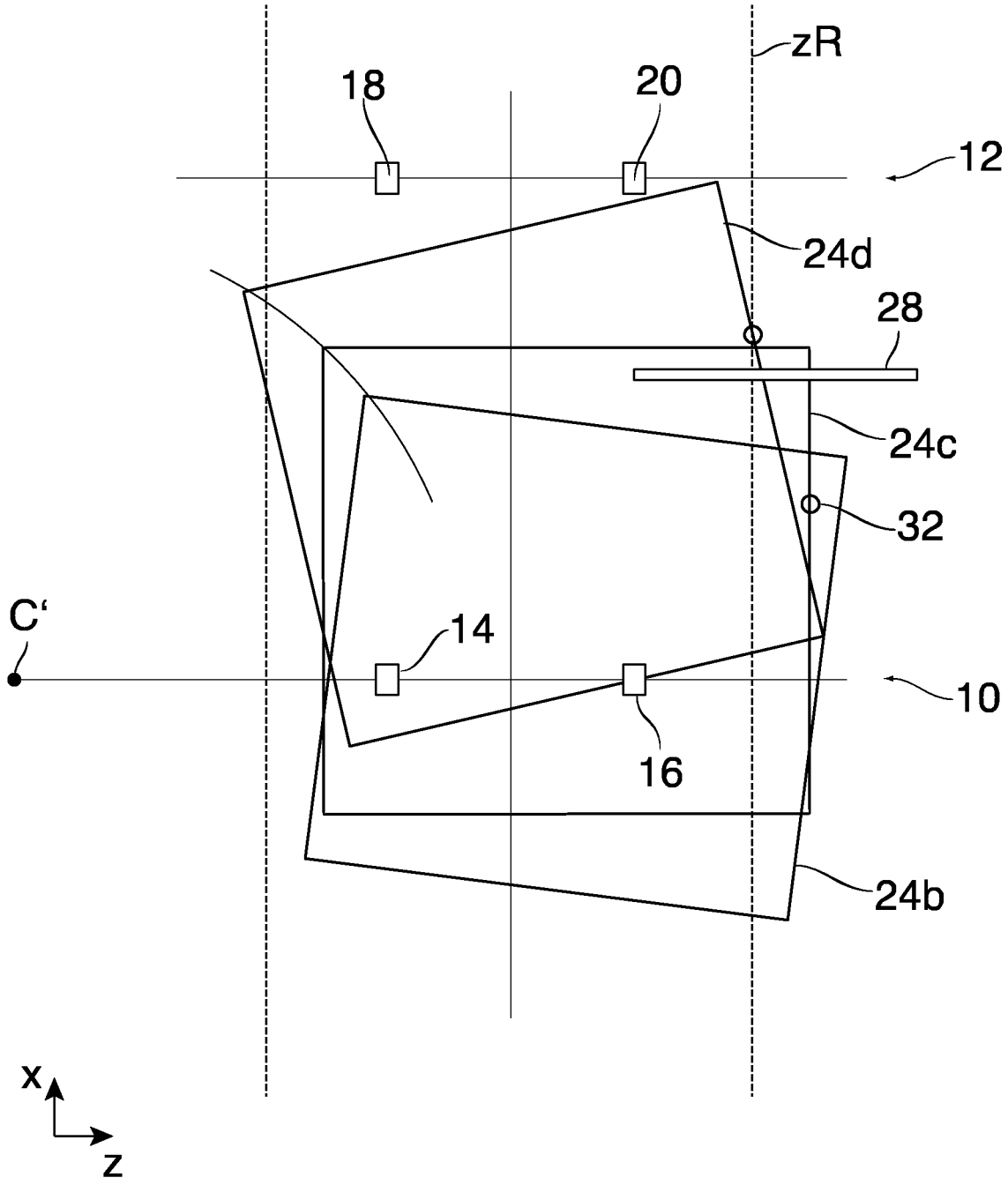
FIG. 5 illustrates a first rotation of the sheet by means of a first pinch roller set of the sheet transport system.

FIG. 5 shows the sheet in the position 24*b* and in two later positions 24*c* and 24*d* during the rotation about the point C'. In the position 24*c*, the skew angle has been fully corrected and the lateral edges of the sheet extend exactly in the transport direction x. In this position, which is reached at known timing, the edge detector 28 can measure a unique z-position of the right edge of the sheet, and the z-position error of the sheet can be determined by comparing the detected edge position to the target position zR for the right edge.

In this stage, a certain reference point 32 may be defined on the leading part of the sheet, i.e. the part of the sheet that is already downstream of the first pinch roller set 10. The exact position of the reference point 32 on the sheet is not critical. In the example shown, the reference point is located on the right edge of the sheet and in some distance from the leading edge.

It is now possible to calculate an angular speed of the further rotation about the point C', i.e. a suitable differential speed of the pinch roller pairs 14 and 16, such that the reference point 32 will reach the target position zR at a time at which the sheet is not yet pinched by the second pinch roller set 18, 20. The position 24*d* in FIG. 5 is the position in which the reference point 32 has just reached the target position. At this moment, the rotation of the sheet about the point C' is stopped, i.e. the pinch roller pairs 14 and 16 are driven with identical speeds, so that the sheet is advanced in positive x-direction without being rotated.

Figure 6:
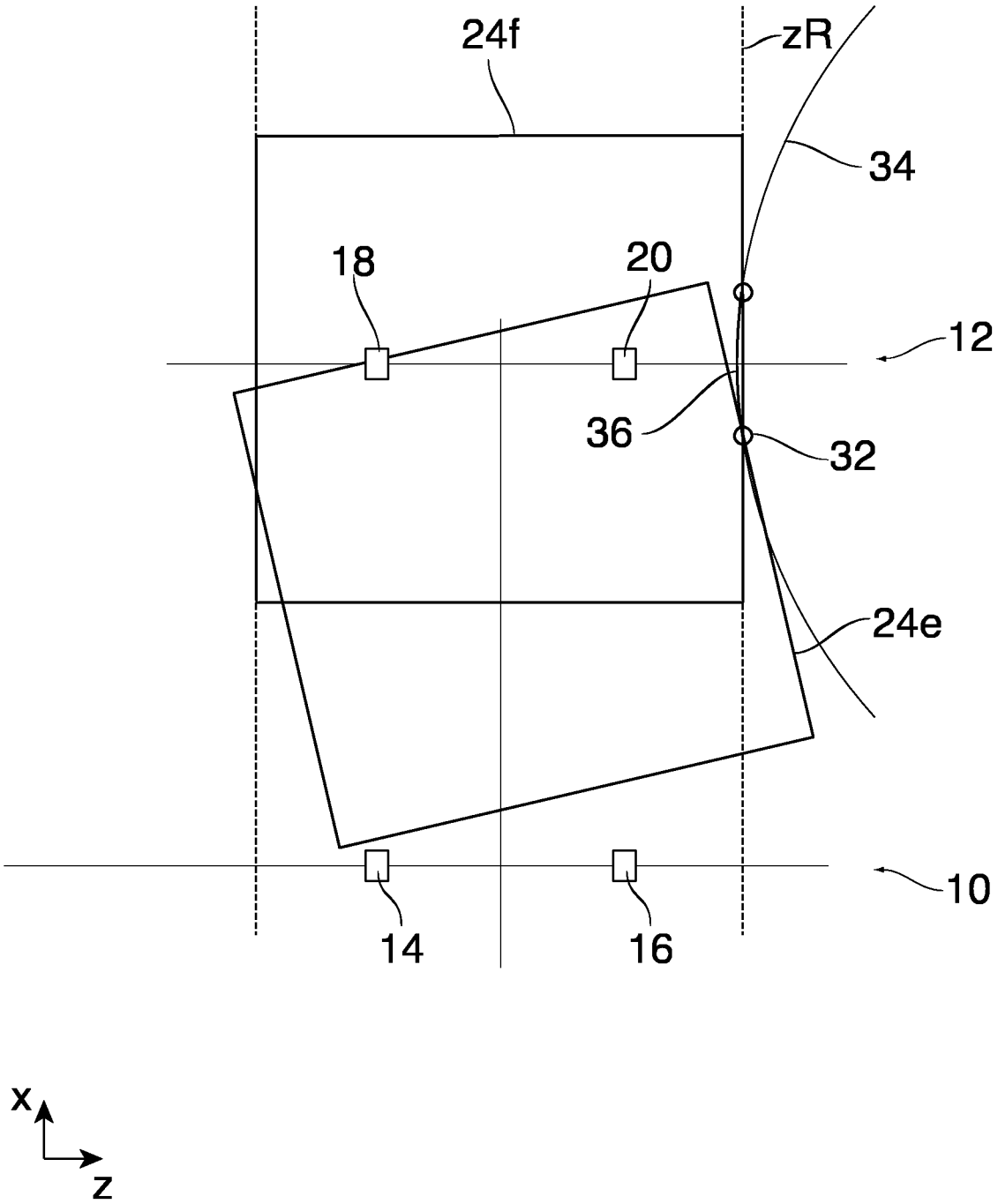
FIG. 6 illustrates a second rotation of the sheet by means of a second pinch roller set of the sheet transport system.

FIG. 6 shows the sheet in a position 24*e* at the end of this pure translational movement. The reference point 32 is still on the target position zR. The sheet is now pinched by the pinch rollers of the second pinch roller set 12 whereas the trailing edge of the sheet has left the first pinch roller set 10.

As a consequence, the sheet can now be rotated by driving the pinch roller pairs 18 and 20 with differential speeds. Since the previous rotation of the sheet has led to a substantial skew error, the sheet will now be rotated in opposite direction in order to correct the skew error, but without spoiling the alignment of the reference point 32 on the target position zR.

It will be observed that the differential speed of the pinch roller pairs 18 and 20 results in a rotation about a center point that is located on the axis of the second pinch roller set 12 (on the right side in FIG. 6 but outside of the area of the drawing). Consequently, the reference point 32 will move on a circular arc 34 about this rotation center. During this movement, the reference point 32 will temporarily leave the reference position zR, but will meet the reference position once again after having travelled through a curved path segment 36 that is symmetric with respect to the second pinch roller set 12. The angular speed and the timing of the rotation are calculated such that the skew angle error will be corrected, i.e. the leading edge of the sheet extends exactly in z-direction at the very moment when the reference point 32 reaches again the target position zR. In this position, designated as 24*f*, both the z-position error and the skew error have successfully been corrected, and the sheet may be advanced further in a pure translational movement in the transport direction x.

It will be observed that, in the process described above, there is still some freedom of choice concerning the translational speed vT in the various stages of the process. This freedom may optionally be utilized for correcting also an x-position error or timing error that may be detected by means of the edge detectors 26 in FIG. 1.

Of course, the edge detectors 26 are also capable of detecting a skew angle of the sheet by detecting the trailing edge of the sheet. This possibility may be utilized for example for checking the result of the first rotation when the sheet moves from the position 24*d* in FIG. 5 to the position 24*e* in FIG. 6.

Although specific embodiments of the invention are illustrated and described herein, it will be appreciated by those of ordinary skill in the art that a variety of alternate and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A sheet transport system for moving a sheet in a transport direction x while adjusting a position of the sheet in a lateral direction z normal to the transport direction x to a target position, the system comprising first and second pinch roller sets spaced apart from one another in the transport direction x, each pinch roller set comprising two pairs of pinch rollers spaced apart from one another in the lateral direction z, each pair forming a nip for pinching and driving the sheet with an individually controllable speed, characterized by comprising a detection system for detecting a position of the sheet in the lateral direction z while the sheet is pinched by the first pinch roller set, and a control system configured for carrying out the following actions:

by controlling the speeds of the pinch rollers of the first pinch roller set before the sheet has reached the second pinch roller set, rotating the sheet by a first rotation angle for adjusting a given reference point on a leading part of the sheet to its target position; and when the sheet has left the first pinch roller set and while the reference point travels along a path segment that is symmetric with respect to the second pinch roller set, rotating, by controlling the speeds of the pinch rollers of the second pinch roller set, the sheet by a second rotation angle for aligning a leading edge of the sheet in the lateral direction z.

2. The system according to claim 1, comprising a detection system for detecting a skew angle of the sheet when the sheet arrives at the first pinch roller set, wherein the controller is configured for controlling the rotation of the sheet induced by the first pinch roller set so as to correct the skew angle error and to detect a z-position error of the sheet in a state in which the skew angle error has been corrected.

3. The system according to claim 1, wherein the control system is configured for controlling a time period in which the second rotation is performed, such that a lateral position of a center of the sheet is left substantially unchanged in the second rotation.

4. The system according to claim 3, wherein the control system is configured for controlling a time period for the second rotation in a time period wherein the second pinch roller set engages a central region of the sheet.

5. The system according claim 1, wherein the detection system further comprises a first edge detector provided upstream of the second pinch roller set for detecting a skew angle of a leading and/or trailing edge of the sheet with respect to the lateral direction z and/or the transport direction x.

6. The system according to claim 1, wherein the detection system further comprises a second edge detector provided at a location between the first and second pinch roller sets for detecting a position of a lateral edge of the sheet in the lateral direction z.

7. The system according to claim 6, wherein the control system is configured for performing the second rotation while a lateral edge of the sheet is positioned over the second edge detector.

8. The system according to claim 7, wherein the second edge detector is a linear detector array extending in the lateral direction z, such that the detection system is able to track a rotation of the sheet during at least part of said rotation, preferably during at least a major part of said rotation.

9. A method for moving a sheet in a transport direction x while adjusting a position of the sheet in a lateral direction z normal to the transport direction x to a target position in a sheet transport system comprising first and second pinch roller sets spaced apart from one another in the transport direction x, each pinch roller set comprising two pairs of pinch rollers spaced apart from one another in the lateral direction z, each pair forming a nip for pinching and driving the sheet with an individually controllable speed, the method comprising the steps of:

detecting a position of the sheet in the lateral direction z while the sheet is pinched by the first pinch roller set, and a control system configured for carrying out the following actions:

controlling the speeds of the pinch rollers of the first pinch roller set before the sheet has reached the second pinch roller set, rotating the sheet by a first rotation angle for adjusting a given reference point on a leading part of the sheet to its target position; and when the sheet has left the first pinch roller set and while the reference point travels along a path segment that is symmetric with respect to the second pinch roller set, rotating, controlling the speeds of the pinch rollers of the second pinch roller set, the sheet by a second rotation angle for aligning a leading edge of the sheet in the lateral direction z.

* * * * *